United States Patent [19]

Derda et al.

[11] Patent Number: 4,718,125

[45] Date of Patent: Jan. 12, 1988

[54] DISPOSABLE MITTEN WITH TABS

[76] Inventors: Roger Derda, 108 W. Pendleton Rd., Banning, Calif. 92220; Robert F. Derda, 66759 Cahuilla Ave., Desert Hot Springs, Calif. 92240

[21] Appl. No.: 929,173

[22] Filed: Nov. 10, 1986

[51] Int. Cl.[4] ..... A41D 19/00

[52] U.S. Cl. ..... 2/158; 2/167

[58] Field of Search ..... 2/158, 159, 162, 167, 2/168

[56] References Cited

U.S. PATENT DOCUMENTS

| | | | |
|---|---|---|---|
| 2,325,482 | 7/1943 | Curran | 2/159 |
| 2,518,424 | 8/1950 | Kaas | 2/162 X |
| 3,384,083 | 5/1968 | Cozza et al. | 2/167 X |
| 4,084,265 | 4/1978 | Anfelt | 2/167 X |
| 4,240,157 | 12/1980 | Peters | 2/167 X |

*Primary Examiner*—Louis K. Rimrodt

[57] ABSTRACT

An improved mitten which is disposable being comprised of high density polyethylene and having tab elements integrally formed therein for easy removal. When said mitten is used by an individual and becomes dirty or is no longer needed, it can be easily removed from the hand and later discarded by grasping one of the two tab elements therein with the opposite hand and peeling said tab element towards the fingers and away from the wrist until removal is accomplished.

2 Claims, 3 Drawing Figures

DISPOSABLE MITTEN WITH TABS

BACKGROUND OF THE INVENTION

1. Field of the Invention

The invention relates generally to an improved covering for the hand which is in the shape of a mitten and is disposable.

2. Description of the Prior Art

Heretofore there has not been available in the marketplace a disposable covering for the hand in the shape of a mitten that contains integrally formed tab elements for easy removal and which is comprised of high density polyethylene.

A disposable covering for the hand is used by an individual for convenience so that when soiled or no longer needed, the covering may be discarded. Prior art shows that there are various types of mittens available which are made of cloth, sponge, vinyl, leather, and other materials, but in no instance has there been available a disposable mitten which is made of high density polyethylene. Prior art also reveals that there are disposable gloves available which are made of polyethylene. The problem inherent with such disposable polyethylene gloves is that when the hand is encased in said device the material of said gloves either makes it fit too tightly or causes the hand to sweat thereby making it very difficult to remove. The annoyance and inconvenience associated with the removal of such gloves is even more apparent when it becomes necessary to utilize the clean fingers of the opposite hand to pull or tug on the finger area of the soiled glove thereby resulting in the clean hand possibly becoming soiled and defeating the purpose for which the disposable glove was designed.

An example for which the improvement of this invention can be evidenced may be demonstrated by showing the inadequacies of utilizing a disposable polyethylene glove for pumping gasoline into an automobile. An ongoing problem associated with automobile service stations and the fueling of automobiles is oftentimes the the handle attached to and integral to the gasoline pump nozzle has gasoline on it because of a leak in the nozzle mechanism; consequently, the individual using said device gets gasoline on his/her hand. Should this occur, the individual must then be inconvenienced by either seeking a place to wash his/her hands or continue on his/her journey with soiled hands and the smell of gasoline fumes in the automobile compartment. At the present time, most people use nothing to protect their hands when pumping gasoline, or if they do, it is usually somekind of makeshift device such as a wadded paper towel or rag. In the event an individual should choose to utilize a disposable polyethylene glove for the purpose of pumping gasoline, they may initially keep their hands from becoming soiled, but when finished and attempt to remove said gloves, find that they soil one or both of their hands in the process as explained previously. The same can be said in instances where people try to use disposable gloves rather than mittens when working with furniture stripper and other similar materials.

This invention provides the individual with an improved mitten which is made of high density polyethylene, has tab elements integrally formed therein for easy removal, is disposable, and eliminates the problems previously cited.

Most users of automobiles therefore would find it desirable to have a covering for their hands which would keep their hands clean and would be easy to remove after pumping gasoline. The same can be said for other tasks which would not require the dexterity that only a glove could provide.

SUMMARY OF THE INVENTION

The invention is an improved mitten comprised of high density polyethylene which is disposable and includes integrally formed tabs therein which allows easy removal of said mitten when soiled or no longer needed.

It is an object of the invention to provide a disposable mitten which will allow easy removal after using said device for such tasks as pumping gasoline into a vehicle or stripping furniture.

It is another object of the invention to provide a disposable covering for the hand which is easier to use and more convenient than existing disposable polyethylene gloves.

It is yet another object of the invention to provide a disposable mitten which is inexpensive to manufacture.

Further objects and advantages of my invention will become apparent from a consideration of the drawings and ensuing description of it.

DRAWING REFERENCE NUMERALS

10—topsheet of high density polyethylene in the shape of a mitten
12—lateral edge of 10
14—cusp shaped tab
16—lateral edge of 14
18—dividing point for fusing
20—backsheet of high density polyethylene in the shape of a mitten
22—lateral edge of 20
24—cusp shaped tab
26—lateral edge of 24
28—dividing point for fusing

DESCRIPTION OF THE PREFERRED EMBODIMENT

Figure 1:
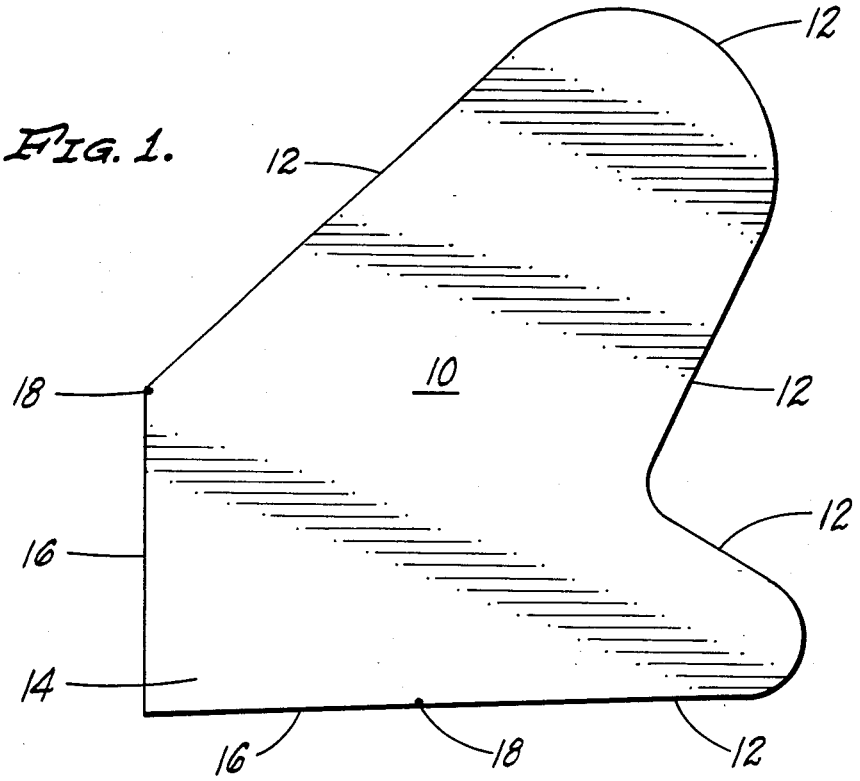
FIG. 1 shows a top view of the topsheet of a disposable mitten according to the invention.
Figure 2:
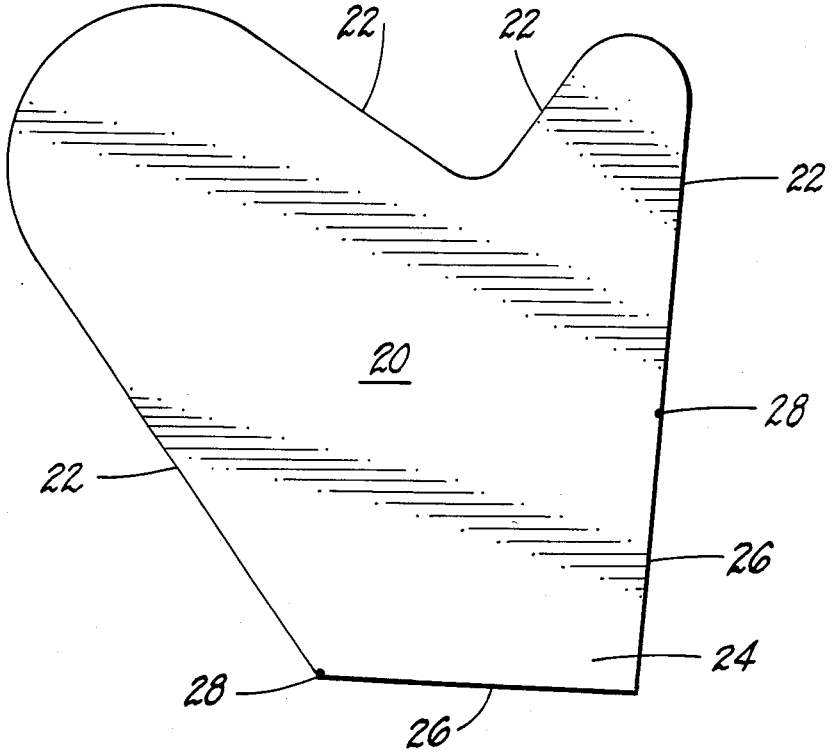
FIG. 2 shows a top view of the backsheet of a disposable mitten according to the invention.

FIGS. 1 and 2 show top elevational views of the top and bottom halves of the improved mitten invention. The topsheet 10 is superposed and fused onto the backsheet 20 in the following manner: the lateral edge 12 is fused with the lateral edge 22 up to dividing points 18 and 28 thereby forming a cavity in the center of fused topsheet 10 and backsheet 20. Cusp shaped tab elements 14 and 24 are integrallly formed therein to topsheet 10 and backsheet 20 respectively. Lateral edges 16 and 26 are not fused so that the cavity created by fusing topsheet 10 and backsheet 20 up to the dividing points 18 and 28 remains open.

Figure 3:
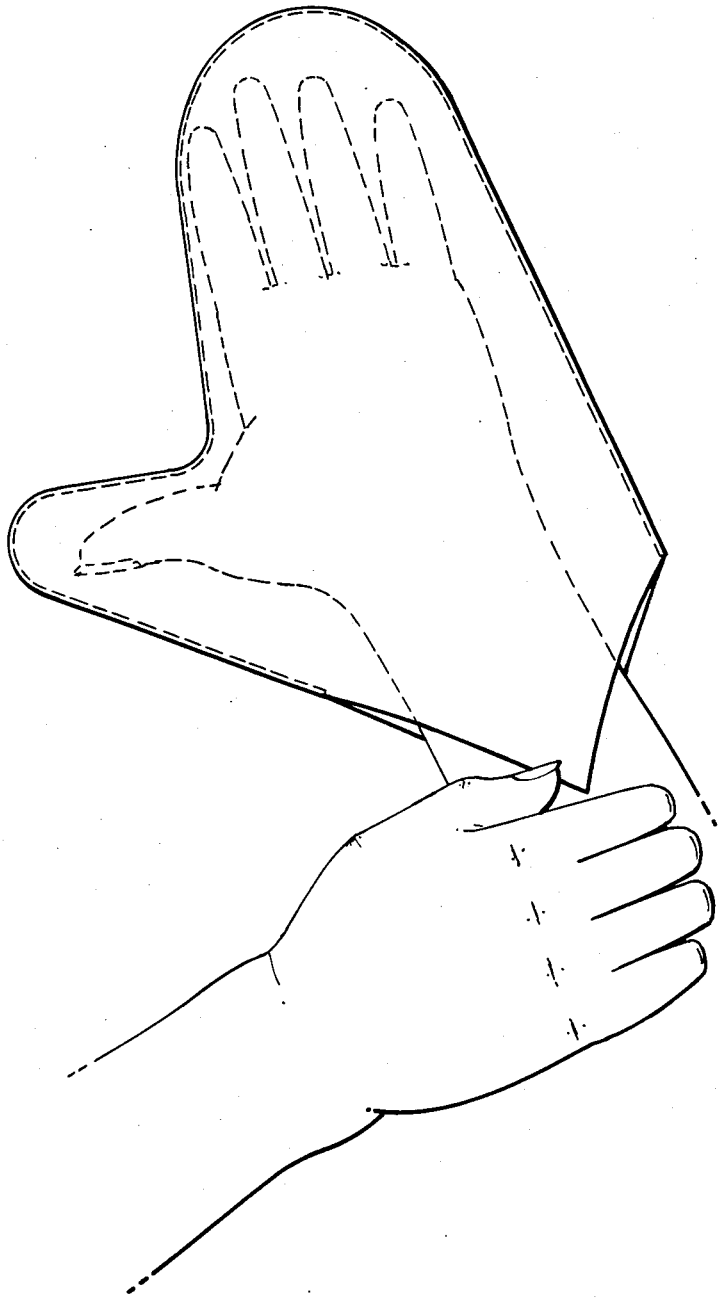
FIG. 3 shows the invention with a human hand inserted in the device and the opposite hand about to grasp one of the cusp shaped tab elements integrally formed therein to remove the device from the hand.

The disposable mitten of FIG. 3 will provide the means for covering a human hand in a wide variety of situations including: the pumping of gasoline into vehicles, stripping furniture, dusting, etc., but users will find it especially helpful when utilized for pumping gasoline.

For this function it is necessary that the topsheet 10 in FIG. 1 be fused with the backsheet 20 in FIG. 2 as previously described. If a human hand was inserted into said device as indicated in FIG. 3 the cusp shaped tab elements 14 and 24 would cover the top and bottom sides of the wrist area. An individual wishing to use the improved invention simply inserts his hand into the cavity of the mitten and proceeds to use the mitten as desired. When the device is no longer needed, the individual removes it by grasping one of the cusp shaped tabs 14 or 24 located on the top and bottom sides of the mitten in relation to the wrist area; utilizing the opposite hand the individual peels the mitten away from the hand. Since said device is reversible and interchangeable, there are always two tabs 14 and 24 available for helping remove the mitten.

Users will find the disposable mitten of FIG. 3 advantageous since the tab elements will provide the means for easily removing the device with the assistance of the opposite hand without having to handle the area of a hand covering which is normally soiled. Users will also find that their hands are less apt to sweat when encased in the high density polyethylene material of the mitten than in standard polyethylene gloves.

While my above description contains many specificities, these should not be construed as limitations on the scope of the invention, but rather as an exemplification of one preferred embodiment thereof. Many other variations are possible. For example, the tab elements which are integrally formed into the improved mitten can also be incorporated into a disposable polyethylene glove. Said gloves could be manufactured to include integrally formed tab elements identical to those utilized in my improved mitten invention, thereby resulting in an improved glove which is also easy to remove. In addition, said improved mitten may be utilized for miscellaneous utility tasks not mentioned in the description of the embodiment. This invention contemplates any configuration, design, and relationship of components which will function in a similar manner and which will provide the equivalent result.

We claim:

1. An improved mitten of sufficient size for encasing the human hand whereby the thumb is separated from the fingers and the material which forms and covers the finger area is without separations for fingers, wherein the improvement comprises cusp shaped tab elements for easy removal of said mitten which are integrally formed therein to the topsheet and backsheet of said mitten whereby said tab elements are located opposite the finger area of said mitten on the taper terminus closest to the topside and bottomside of the wrist if a human hand were encased in said mitten.

2. The improved mitten of claim 1 wherein the material of said improved mitten is comprised of high density polyethylene, making said improved mitten disposable and whereby the utilization of the improved polyethylene material produces a stronger and more durable disposable mitten.

* * * * *